US006240977B1

(12) United States Patent
Gilpatrick

(10) Patent No.: US 6,240,977 B1
(45) Date of Patent: Jun. 5, 2001

(54) METHOD AND APPARATUS FOR IMPARTING AND ALTERNATING TWIST AND WEAVING A MULTI-PLY YARN IN CONTINUOUS MOTION

(75) Inventor: Michael W. Gilpatrick, Chesnee, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/656,104

(22) Filed: Sep. 6, 2000

(51) Int. Cl.[7] ..... D03D 47/34

(52) U.S. Cl. ..... 139/450; 139/11; 139/116.1; 57/293

(58) Field of Search ..... 139/11, 116.1, 139/450; 57/293, 333, 350

(56) References Cited

U.S. PATENT DOCUMENTS 5,295,516 * 3/1994 Tanaka et al. ..... 139/452
5,937,915 * 8/1999 Wahhoud ..... 139/450

* cited by examiner

*Primary Examiner*—John J. Calvert
*Assistant Examiner*—Robert H. Muromoto, Jr.
(74) *Attorney, Agent, or Firm*—Terry T. Moyer; Thomas L. Moses

(57) ABSTRACT

An improved assembly for alternating twist in yarn, utilizing a pair of air jets in which compressed air is supplied producing a vortex that causes the yarn passing therethrough to experience a torque about the yarn's longitudinal axis. This apparatus is used to provide an alternating twist to fill yarn as the yarn is being fed into the loom. The twisting unit operates by imparting "s" twist for a certain period of time while the yarn is in linear motion, followed by imparting a "z" twist for another certain period of time, in repeating fashion. The net twist in the yarn so treated is zero. Preferably, the twisting of the fill yarn is coordinated with the loom so that the twist direction is reversed prior to each successive filling insertion. This method produces a woven product that contains no yarn regions having an area of zero twist commonly found in weaves produced by alternate twist yarn, because the twist reversal occurs during a time when no filling is being inserted, and occurs spatially outside of the boundaries of the woven cloth.

13 Claims, 4 Drawing Sheets

METHOD AND APPARATUS FOR IMPARTING AND ALTERNATING TWIST AND WEAVING A MULTI-PLY YARN IN CONTINUOUS MOTION

BACKGROUND OF THE INVENTION

This invention relates to an improved apparatus and method for manufacturing woven products utilizing alternating twist (or net zero twist) yarn. There are a number of methods for producing yarn and fabrics that have a net zero twist.

One method for producing alternating twist yarn is by using reversible motors, which can be used to alternately cause a yarn to be twisted one way and then the other. Such motors, however, are relatively expensive and complex. These motors are also subject to mechanical breakdown. Another means of producing net zero twist yarn is by utilizing a pair of airjets, with the first jet capable of twisting the yarn in the opposite direction to that of the second, and periodically alternating the flow of actuating air from one jet to the other. However, it is found that polymer particles, trimer, loose dyestuff, and other debris can become lodged in the air jet when it is not actuated, preventing subsequent normal operation. This problem is significant since it can destroy the commercial viability of this process.

The use of twisted yarns in woven products is well known in the art. Traditionally, the yarn is passed through a mechanism for applying the twist, and is then rolled back onto a spool or bobbin. The bobbin is then transported to a loom to provide yarn for the weaving process. Thus, using twisted yarns has heretofore been a two-step process.

Thus, it would be desirable to provide an apparatus and method for alternately twisting yarn that allows the yarn to be twisted and woven in a single continuous, streaming step. Another desirable feature would be to provide an in-line air-jet yarn twisting apparatus that significantly reduces or eliminates the problem of debris becoming lodged in the air jet when it is not actuated. One effort to solve a few of these problems is described in U.S. patent application Ser. No. 08/725,647, filed Oct. 1, 1996, which is hereby incorporated herein by specific reference in its entirety.

SUMMARY OF THE INVENTION

This invention relates to an improved assembly for imparting alternating twist to yarn in continuous motion by utilizing a pair of air jets into which compressed air is alternately supplied producing a vortex that causes the yarn passing therethrough to experience a torque about the yarn's longitudinal axis. This assembly is attached to a loom in a manner so that initially untwisted yarn passes therethrough immediately before being inserted into the weft of the woven product.

The two air jets are arranged in-line so that the torque direction induced by one is opposite to that induced by the other. Air pressure is alternately applied at a desired cycling frequency to each jet to produce the alternate "s" and "z" twist in the yarn. There is a bias or backing air pressure that is applied on whichever jet is not being activated. This backing air pressure is typically a fraction of the air pressure utilized on the activated jet. This is extremely useful in preventing polymer particles, trimer, loose dyestuff, and other debris from becoming lodged in the unused air jet, preventing its subsequent normal operation. The cycling frequency may be coordinated with the weaving process in such a way that switching from the "s" twist to the "z" twist, and vice versa (reversing the twist), occurs prior to each successive weft insertion. When yarn is woven in this manner, the regions of zero twist commonly found in yarns of this type are eliminated from the woven product, because they occur during the time when no filling is being inserted, and they occur spatially outside the boundaries of the woven cloth. Furthermore, when the yarn is woven in this manner, alternating weft yarns possess alternating twist directions, and the woven product has a balanced torque. Woven products having a balanced torque have no tendency to roll or curl.

An advantage of the present invention is that the twisting process can be performed inline with the weaving process while the yarn is in continuous motion, thereby combining two steps into a single, more efficient step. Yet another advantage of the present invention is the ability to produce woven products having a balanced torque, having a net twist of zero, without including individual yarns having areas of zero twist within the weave. It is another advantage to create unique fabrics having varying amounts of twist. Another advantage of this invention is to eliminate impurities from clogging an air jet, and thereby thwarting its operation.

Fabrics produced by this process are torque balanced, meaning that there are equal numbers of fill yarns having "s" twist as there are having "z" twist. This feature is important, particularly where the fabric is to be subjected to subsequent processes or where the tendency for the fabric to roll up or twist would be detrimental. Heretofore, the only way to arrange the fill yarns in this way was to prepare, off-line, two yarns where one has an "s" twist and the other has a "z" twist, and then to insert them alternately within the weave to create the fabric in a twist balanced or zero torque manner. The present apparatus and method achieves this balance without the necessity of pre-twisting the yarns using a conventional and expensive twisting process.

Fabrics produced by this process are particularly useful in such applications as conveyor belts, tire reinforcement belts, drive belts, etc.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
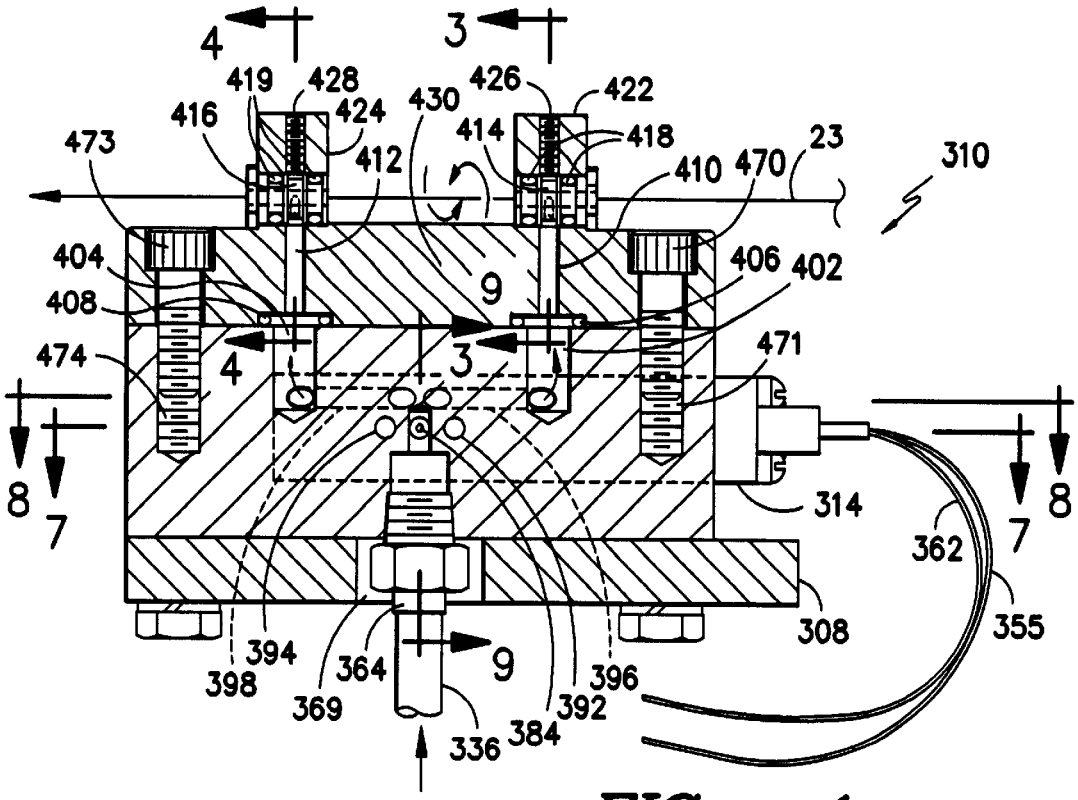
FIG. 1 is a sectional view of a yarn twisting mechanism with a first air jet on the right rotating the yarn in a clockwise direction with air under relatively high pressure.
Figure 2:
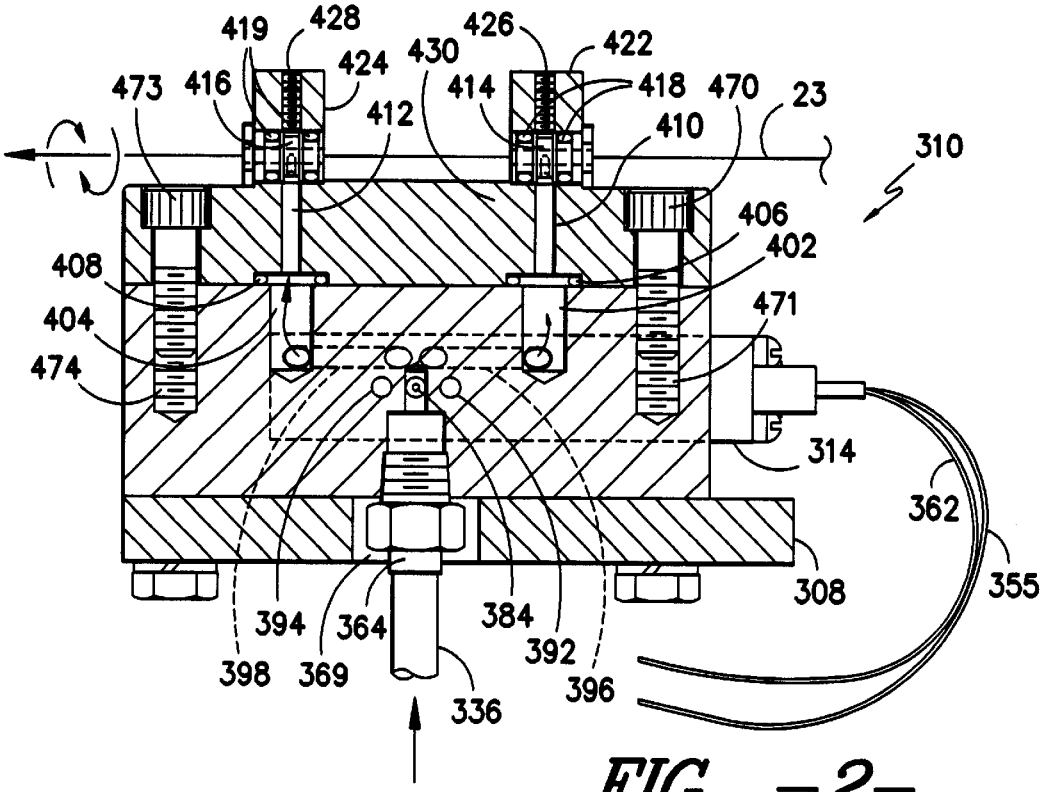
FIG. 2 is a sectional view of the yarn twisting mechanism shown in FIG. 1 with a second air jet on the left rotating the yarn in a counter-clockwise direction with air under relatively high pressure.

Referring now to FIGS. 1 and 2, a cross section of one embodiment of an in-line alternate yarn twisting device is shown. This apparatus is preferably attached to a loom so that the fill yarn passes through the apparatus in the direction shown immediately before being inserted by the loom into a woven product. This arrangement eliminates the need for separately twisting the yarn, rewinding it onto a bobbin or the like, and then using the resulting bobbin to feed the loom.

Referring now to FIGS. 1 and 2, the manifold inlet fitting 364 is threadedly attached to the manifold 310 and located within an aperture 369 formed in support panel 308. The spool valve 314 is attached to the manifold 310 by a pair of suitable attachment bolts not shown.

Figure 9:
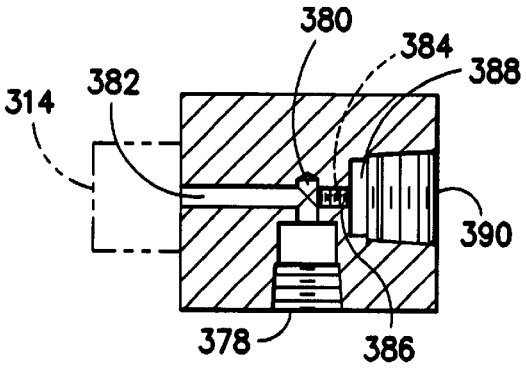
FIG. 9. is a sectional view taken on Line 9—9 of FIG. 1.

Referring now to FIG. 9, pressurized air flows from the air jet orifice 378 into an airjet flow tube 380 and into the spool valve 314 by means of a high pressure air flow line 382. Air also flows from air jet flow tube 380 through a screw with a 0.020 inch diameter aperture 384, which forms a restrictor 386, and thereby exits the restrictor at low pressure. With this type of constraint, the air must be very clean in order for this restrictor 386 to function. This low pressure air flows into a threaded chamber 388 that is sealed on one end by a threaded plug 390. As shown in FIG. 7, the low pressure air exits the unsealed end of threaded chamber 388 by means of two low pressure air lines 392 and 394, respectively. Therefore, the high pressure air flow line 382 and the two low pressure air flow lines 392 and 394 all flow into the spool valve 314 as shown in FIGS. 1, 2, 5, 6, and 7. There is a first outlet flow line 396 and a second outlet flow line 398 from which pressurized air exits from the spool valve 314, as shown in FIGS. 1, 2, 5, 6, and 8.

Figure 3:
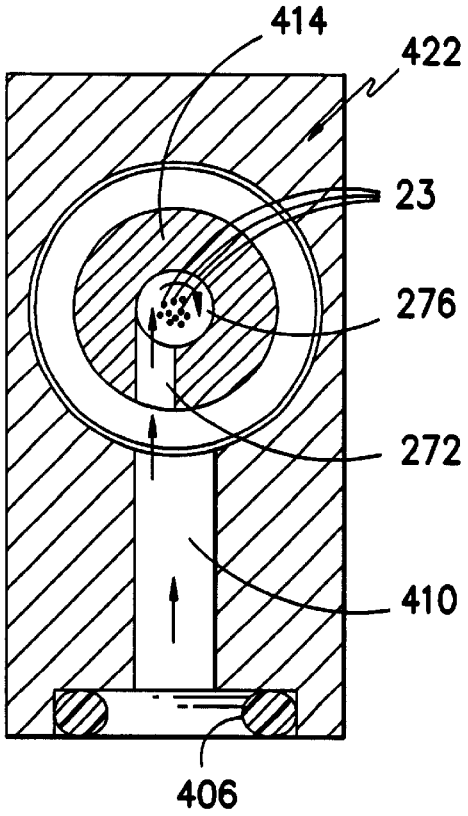
FIG. 3 is a sectional view taken along Line 3—3 of FIG. 1 of the first air jet, demonstrating the first air jet that rotates yarns in a clockwise direction.

As shown in FIGS. 1, 2, and 3, the pressurized air from the first outlet flow line 396 flows into a first air chamber 402, past a first air jet o-ring 406, into a secondary, first air jet chamber 410 and then into the first air jet 414 to either twist the yarn 23 or to merely provide enough air ressure to clear debris. The first air jet 414 is held in position by a first support structure 422 and with a pair of first, outer air jet o-rings 418 on each side of the first air jet 414 within the first support structure 422. There is a first set screw 426 that extends from an aperture in the top of the support structure 422 to hold the first air jet 414 in a fixed position.

Figure 4:
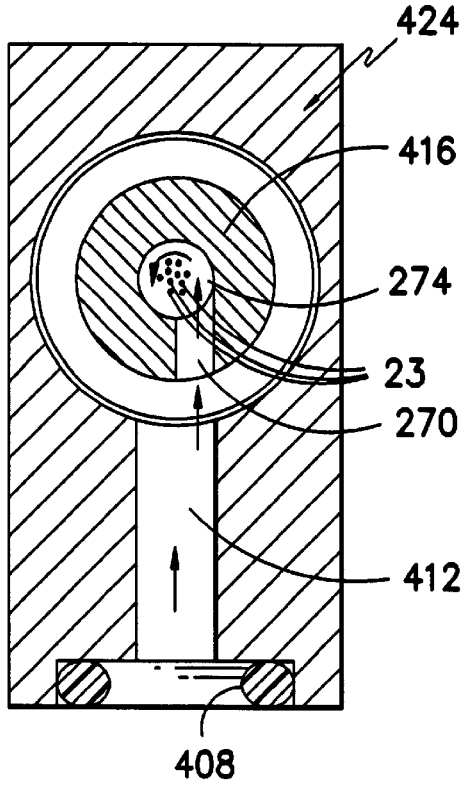
FIG. 4 is a sectional view taken along Line 4—4 of FIG. 1 of the second air jet, demonstrating the second air jet that rotates yarns in a counter-clockwise direction.

As shown in FIGS. 1, 2, and 4, the pressurized air from the second outlet flow line 398 flows into a second air chamber 404, past a second air jet O-ring 408, into a secondary, second air chamber 412 and then into the second air jet 416 to either twist the yarn 23 or merely to provide enough air pressure to clear debris. The second air jet 416 is held in position by a second support structure 424 with a pair of second, outer air jet O-rings 419 on each side of the second air jet 416 within the second support structure 424. There is a second set screw 428 that extends from an aperture in the top of the second support structure 424 to hold the second air jet 416 in a fixed position.

The secondary, first air chamber 410 and the secondary, second air chamber 412 are formed as apertures in a plate 430 that is attached to the manifold by the first series of two (2) bolts 470 in the first series of two (2) apertures 471 and the second series of two (2) bolts 473 in the second series of two (2) apertures 474.

As shown in FIG. 1, the high pressure is applied to the first air jet 414 while the low pressure air or bias pressure is applied to the second air jet 416. In FIG. 2, the situation is reversed with the low pressure air or bias pressure being applied to the first air jet 414 and the high presure applied to the second air jet 416. In a preferred embodiment, the high pressure air falls within the range between 20 and 120 pounds per square inch, and the low pressure air falls within the range between 1 and 12 pounds per square inch.

As shown in FIG. 3, the yarn is twisted in a clockwise manner due to the fact that the first air jet 414 includes a secondary, first air jet orifice 272 which is slightly off-center to the left of the top of the first air jet twisting chamber 276 which twists the yarn 23.

As shown in FIG. 4, the yarn is twisted in a counter-clockwise manner due to the fact that the second air jet 416 includes a secondary, second air jet orifice 270 which is slightly off-center to the right of the top of the first air jet twisting chamber 274 which twists the yarn 23.

Comparing FIGS. 3 and 4, it is seen that one jet is causing the yarn passing therethrough to be twisted in one direction while the other jet is causing the yarn passing therethrough to be twisted in the opposite direction. The resultant twist in the yarn is determined by which of the two jets is supplied with the high pressure actuating air. If the high pressure air is applied to the first jet 414 and the bias or blocking air is applied to second jet 416, then the twisting effect of the first jet 414 overpowers that of second jet 416, and the yarn 23 will possess an "s" twist when exiting the device in the direction shown. However, if the high pressure air is applied to the second jet 416 and the bias or blocking air is applied to the first jet 414, then the twisting effect of the second jet 416 will overpower that of the first jet 414, and the yarn 23 will possess a "z" twist when exiting the device in the direction shown.

Figure 5:
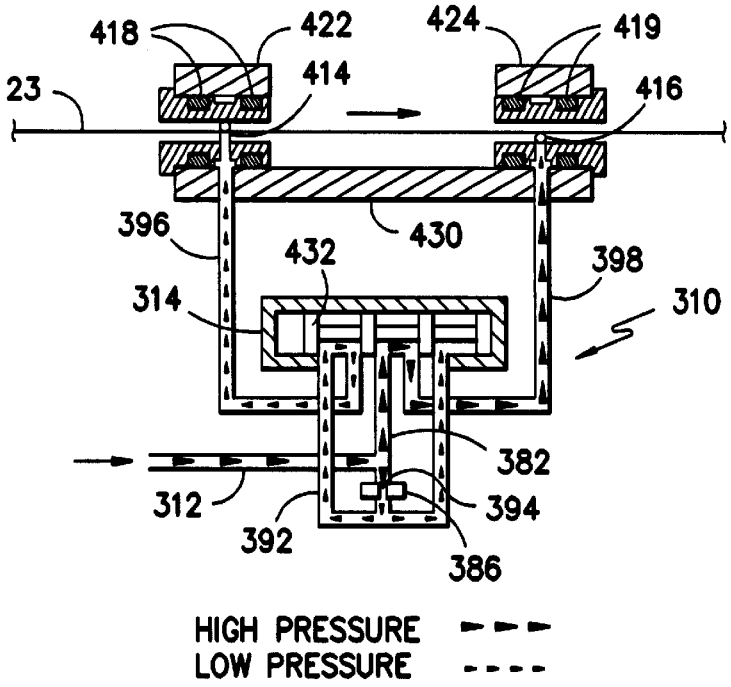
FIG. 5 is a schematic view of an alternating twist yarn assembly of the present invention with a valve spool in an "s" activated position.
Figure 6:
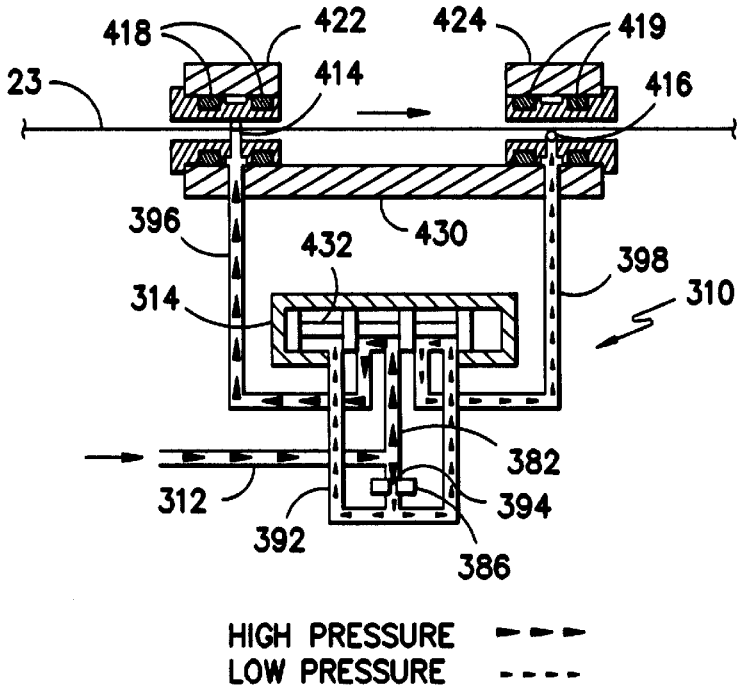
FIG. 6 is a schematic view of an alternating twist yarn assembly of the present invention with the valve spool in a "z" activated position.
Figure 7:
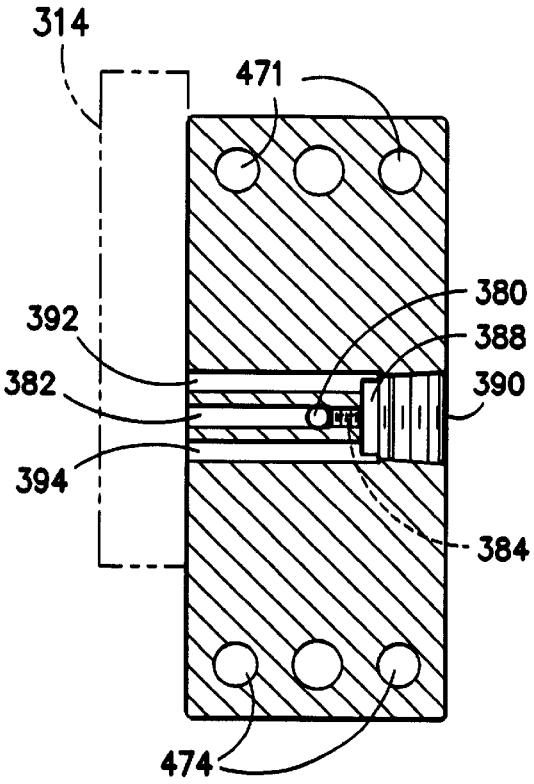
FIG. 7 is a sectional view taken on Line 7—7 of FIG. 1.
Figure 8:
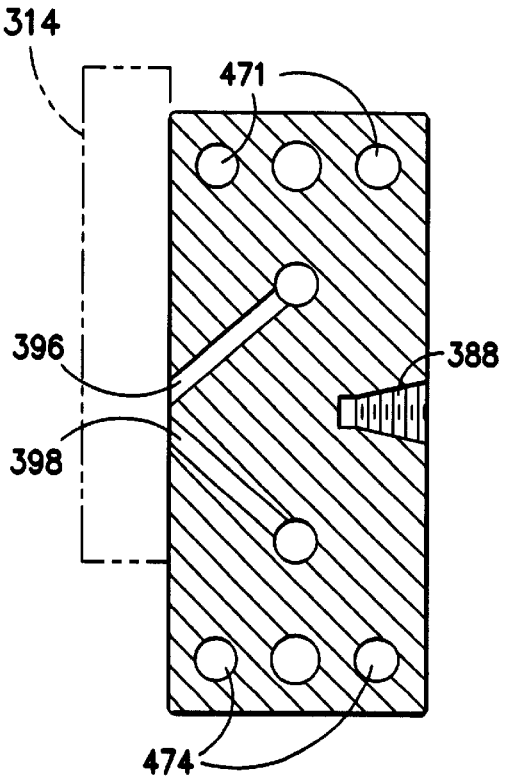
FIG. 8 is a sectional view taken on Line 8—8 of FIG. 1.

Referring now to FIGS. 5 and 6, the operation of the spool valve 314 will be described. Referring to FIG. 5, the pressurized air flows into the manifold 310 by means of the air supply tube 312 with the high pressure, unrestricted air going into the high pressure air flow line 382. This high pressure, unrestricted air goes into the spool valve 314 and is diverted directly into the second outlet flow line 398 that flows directly into the second air jet 416. This diversion with the spool valve 314 is due to the valve spool 432 being shifted to the right. Air flowing into the air supply tube 312 is also diverted into a restrictor 386 and then split into a first low pressure air line 392 and a second low pressure air line 394. The valve spool 432 prevents the low pressure air from reaching the second air jet 416. The low pressure air flowing from the first low pressure air line 392 flows into the spool valve 314 and is directly diverted into the first outlet flow line 396 that flows directly into the first air jet 414. It should be noted that yarn may pass through the two orifices in either direction relative to the yarn twisting unit.

Referring now to FIG. 6, the pressurized air flows into the manifold 310 by means of the air supply tube 312 with the high pressure, unrestricted air going into the high pressure air flow line 382. This high pressure, unrestricted air goes into the spool valve 314 and is diverted directly into the first outlet flow line 396 that flows directly into the first air jet 414. This diversion with the spool valve 314 is due to the valve spool 432 being shifted to the left. Air flowing into the air supply tube 312 is also diverted into a restrictor 386 and then split into a first low pressure air line 392 and a second low pressure air line 394. The valve spool 432 prevents the low pressure air from reaching the first air jet 414. The low pressure air flowing from the second low pressure air line 394 flows into the spool valve 314 and is directly diverted into the second outlet flow line 398 that flows directly into the second air jet 416.

In a preferred embodiment, the valve spool 432 is actuated by an electric switch (not shown) that is responsive to a proximity sensor on the loom, so that the electric switch changes the position of the spool valve prior to each successive filling insertion. The sensor may sense any suitable element of the loom, such as the picking apparatus, the shed forming apparatus, the beat up apparatus, or any other desirable mechanical element. The electric switch may be actuated in a variety of other ways, including, but not limited to photoelectric sensors, magnetic sensors, or mechanical means.

The wavelength of either the "s" twist portion or the "z" twist portion is equal to the speed of the yarn going through both a first air jet and a second air jet divided by the cycling frequency. This yarn speed can range between zero to five hundred (500) yards per minute. A cycle frequency is the number of times the high pressure air is being applied to a first air jet and then to a second air jet and then back to the first air jet per unit of time. Cycling frequency is defined in cycles per minute. The frequency can range from one to six hundred (600) cycles per minute.

The twisting apparatus may be attached to a loom in any suitable manner, so long as the air jets are positioned between the yarn source or supply and the loom, so that the twisting occurs after the yarn has left the yarn source and before it is woven into the fabric. It is preferable to position the twisting apparatus in close proximity with the loom, so that the twisted yarn does not become unraveled or otherwise lose any twist before being inserted into the weave.

This apparatus is used to provide an alternating twist to fill yarn as the yarn is being fed into the loom. The twisting unit operates by imparting "s" twist for a certain period of time, followed by imparting a "z" twist" for another certain period of time, in repeating fashion. The net twist in the yarn so treated is zero. Preferably, the twisting of the fill yarn is coordinated with the loom so that the twist direction is reversed prior to each successive filling insertion. This method produces a woven product that contains no yarn regions having an area of zero twist, because the twist reversal occurs during a time when no filling is being inserted, and occurs spatially outside of the boundaries of the woven cloth.

While the invention has been described and disclosed in connection with certain preferred embodiments and procedures, these have by no means been intended to limit the invention to such specific embodiments and procedures. Rather, the invention is intended to cover all such alternative embodiments, procedures, and modifications thereto as may fall within the true spirit and scope of the invention as defined and limited only by the appended claims.

What is claimed is:

1. A method for alternately twisting and simultaneously weaving yarn into a woven article in a continuous, streaming process, said method comprising the steps of:

providing at least one stream of yarn in continuous motion;

twisting said yarn in a first direction for a certain period of time;

twisting said yarn in a second direction for a certain period of time; and weaving said twisted yarn into the weft of a woven article.

2. The method set forth in claim 1, further comprising the step of providing a pair of opposed air jets to impart twist to said yarn in both directions.

3. The method set forth in claim 1, further comprising the step of coordinating a change in said twist direction with the weaving step so that the twist direction is reversed prior to each successive filling insertion in said weaving step, thereby preventing any region of said yarn having zero twist from being included in said woven article.

4. The method set forth in claim 1, wherein said stream of yarn is moving at a rate of between zero and five hundred yards per minute.

5. The method set forth in claim 1, wherein said twist direction is alternated at a rate of between one and six hundred cycles per minute.

6. The method set forth in claim 2, wherein high pressure air is supplied alternately to one air jet and then to the other air jet.

7. The method set forth in claim 6, wherein low pressure air is supplied alternately to one air jet and then to the other air jet, so that whenever high pressure air is applied to one air jet, the other air jet receives low pressure air.

8. An apparatus for alternately twisting yarn being transferred from a yarn source to a loom, said apparatus providing alternate twist to yarn in continuous motion, and said apparatus comprising:

a first air jet, having a first orifice, for receiving and rotating yarn in a first spin direction; a second air jet, having a second orifice, for receiving and rotating yarn in a second spin direction;

means for supplying high pressure air to said first and second air jet; means for supplying low pressure air to said first and second air jet; and switch means for alternating between (a) a pressure configuration that supplies high pressure to said first air jet and low air pressure to said second air jet; and (b) a pressure configuration that supplies high pressure to said second air jet and low air pressure to said first air jet;

wherein said yarn passes through said first orifice and said second orifice while in continuous motion toward said loom, and wherein said spin direction of said yarn is determined based on which air jet is receiving high air pressure.

9. The apparatus set forth in claim 8, wherein said yarn streams through said first orifice and said second orifice at a rate of speed in the range of zero to five hundred yards per minute.

10. The apparatus set forth in claim 8, further including means for supplying high pressure air between 20 and 120 pounds per square inch to each of said air jets.

11. The apparatus set forth in claim 8, further including means for supplying low pressure air between 1 and 12 pounds per square inch to each of said air jets.

12. The apparatus set forth in claim 8, wherein said air jets alternate between pressure configurations at a cycling frequency of between 1 to 600 cycles per minute.

13. The apparatus set forth in claim 8, further comprising a proximity sensor that senses motion of said loom and is actuated by the action of said loom, said proximity sensor being in operative communication with said switch means, so that each time said proximity sensor is actuated, said switch means is in turn actuated, and the pressure configurations are switched, thereby reversing the twist direction of said yarn.

* * * * *